US006018898A

United States Patent [19]

Auty et al.

[11] Patent Number: 6,018,898

[45] Date of Patent: Feb. 1, 2000

[54] MESSAGE DISPLAY ELEMENTS AND JACKET

[76] Inventors: Brian Auty; Des Maynard, both of 3515 Hawkestone Road, Mississauga, Ontario, Canada, L5C 2V1

[21] Appl. No.: 09/186,156

[22] Filed: Nov. 5, 1998

[51] Int. Cl.[7] ..... G09F 3/20; G09F 7/02; G09F 3/18

[52] U.S. Cl. ..... 40/5; 40/618; 40/661; 40/661.08; 40/611

[58] Field of Search ..... 40/5, 618, 611, 40/661.08, 661.03, 661

[56] References Cited

U.S. PATENT DOCUMENTS

| | | | |
|---|---|---|---|
| 1,462,825 | 7/1923 | Ringler . | |
| 1,824,794 | 9/1931 | Rohlfes . | |
| 2,202,268 | 5/1940 | Rohlfes . | |
| 2,626,472 | 1/1953 | Stingl . | |
| 4,334,372 | 6/1982 | Colmar . | |
| 4,453,324 | 6/1984 | Greenberger . | |
| 4,791,739 | 12/1988 | Hetzer . | |
| 4,810,544 | 3/1989 | Hickman | 40/661 X |
| 5,199,199 | 4/1993 | Garfinkle . | |
| 5,323,553 | 6/1994 | Candido | 40/661 X |
| 5,848,698 | 12/1998 | Stompe | 40/661.08 X |

FOREIGN PATENT DOCUMENTS

| | | |
|---|---|---|
| 105060 | 7/1942 | Sweden . |
| 141436 | 11/1930 | Switzerland . |
| 239885 | 7/1926 | United Kingdom . |
| 674241 | 6/1952 | United Kingdom . |

*Primary Examiner*—Terry Lee Melius
*Assistant Examiner*—Rodrigo J. Morales
*Attorney, Agent, or Firm*—Nixon & Vanderhye P.C.

[57] ABSTRACT

A message display element, and a message display jacket utilizable with the element (and a plurality of identical or similar elements) allows a message to be effectively displayed, yet the message changed in a simple and effective manner. A message display element comprises a piece of sheet material (such as polyvinyl chloride or polyolefin having a thickness of between about 8–20 mils) that may be more easily folded than conventional constructions even when made of stiffer material, and which lays flatter when folded. The message display element is particularly suited for displaying pricing information, and positioning and orientation indicia may be provided on individual panels of the element to facilitate proper location within the jacket. The jacket may be formed by first and second substantially planar elements, at least the second of which is substantially transparent, pivotally connected at or adjacent bottom edges thereof, and allowing insertion of panels between them, and removably connected to each other adjacent the top edges by a bent over portion of the second panel acting as a latch mechanism.

19 Claims, 5 Drawing Sheets

MESSAGE DISPLAY ELEMENTS AND JACKET

BACKGROUND AND SUMMARY OF THE INVENTION

Simple pricing display systems, such as shown in U.S. Pat. Nos. 1,462,825, 1,824,794, 2,202,268, 2,626,472, and 4,334,372 (the disclosures of which are hereby incorporated by reference herein) can be very useful in displaying messages, particularly pricing information, in such a way that the message displayed may be easily changed, for example to accommodate periodic fluctuations in prices. While such systems have been effective, they have several drawbacks associated therewith, primarily in the construction of the price strips that are associated therewith. Typically, these price strips are formed by a single strip of paper or the like which is folded into equal size panels, with indicia on opposite faces of the panel. This construction makes the folded up strip bulkier than is desirable, so that it does not lay as flat as desired, makes it difficult to make the strip out of relatively stiff material, such as polyvinyl chloride, or polyolefin, plastic. Also, the jackets or frames which mount the pricing information typically are bulky and relatively expensive.

According to the present invention, a message display element is provided that has a number of advantages over the conventional display elements (pricing strips), and for use with a display jacket that is of simple construction and inexpensive, yet is readily utilizable. In practicing the invention it is possible to make durable message display elements, yet ones that can fold easily and when folded lay flat better than conventional constructions.

According to one aspect of the present invention a message display element is provided comprising the following components: A substantially integral piece of sheet material having top and bottom substantially parallel edges, first and second substantially parallel side edges, and top and bottom faces, the side edges substantially perpendicular to the top and bottom edges. At least first and second fold lines substantially parallel to the top and bottom edges, and at least a third fold line substantially parallel to the first and second side edges, the fold lines defining the sheet material into at least first, second, and third substantially in-line panels between the first side edge and the third fold line, and at least fourth and fifth substantially in-line panels between the second side edge and the third fold line. Message indicia provided on both the top and bottom faces of at least a plurality of the panels. And the fourth and fifth panels being unconnected to each other and connected to the first, second, or third panels substantially only at the third fold line. The fact that the fourth and fifth panels are unconnected to each other and the element is more than one panel wide allows the sheet material to be folded so that it lays flatter, and to be made of stiffer, more durable, material, yet be effectively handled.

In a preferred embodiment the sheet material has a sixth panel substantially in line with the fourth and fifth panels and substantially unconnected thereto, and connected to the first, second, or third panel substantially only along the third fold line. The display element preferably consists of six panels. The message indicia is preferably provided on top and bottom faces of at least four of the panels, and preferably is pricing indicia, such as each of the numerals 0 through 9 being provided on one face of one panel. The message indicia may be provided on all of the panels.

In the preferred embodiment, the sheet material is plastic, preferably between about 8–20 mils thick (or any various range within that broad range), so that it is durable yet clearly retains and displays the message indicia thereon. When the display element is primarily for indoor use, the plastic preferably is polyvinyl chloride (PVC), whereas when the display element is primarily for outside use the sheet material is preferably polyolefin.

The display element is typically used in a mounting jacket or frame, and preferably at least some of the panels have orientation and positioning indicia thereon to facilitate proper orientation and positioning of the display element in a jacket. For example, if four similar (though not identical) display elements are mounted in a common jacket, indicia indicating the position of each in the jacket, as well as the orientation (up or down) of a particular edge of each panel, may be provided on at least some (or all) of the panel faces.

The display element may be provided, by itself but preferably with other similar, though typically not identical, display elements in a common display jacket. One particular preferred form according to the invention comprises the following components: A first substantially planar element having dimensions larger than the dimension of any one panel of the sheet material, and having substantially parallel top and bottom edges. A second substantially transparent, substantially planar element having top and bottom edges. The first and second substantially planar elements pivotally connected together at the bottom edges thereof. A plurality of panels having message indicia thereon disposed between the first and second substantially planar elements so that the message indicia is visible through the substantially transparent second element. A readily releasable latch mechanism which holds the first and second substantially planar elements in a predetermined relationship with respect to each other to retain the folded display element therebetween, so that the message display indicia on one of the panels is readily viewed through the substantially transparent second substantially planar element. And the first and second substantially planar elements, the pivot, and the latch mechanism, comprising an integral piece of plastic.

Preferably the display jacket includes instructional indicia, preferably in graphic (pictorial) form, illustrating the proper folding of the display elements for use in association with the display jacket, that indicia provided on the first substantially planar element and visible through the second substantially transparent planar element. The latch element is preferably a turned over portion of the second element, defining a top edge thereof.

According to another aspect of the present invention a message display element is provided comprising the following: A substantially integral piece of sheet material having top and bottom substantially parallel edges, first and second substantially parallel side edges, and top and bottom faces, the side edges substantially perpendicular to the top and bottom edges. At least first and second fold lines substantially parallel to the top and bottom edges, and at least a third fold line substantially parallel to the first and second side edges, the fold line defining the sheet material into at least first, second, and third substantially in-line panels between the first side edge and the third fold line, and at least fourth and fifth substantially in-line panels between the second side edge and the third fold line. Message indicia provided on both the top and bottom faces of at least a plurality of the panels. And orientation and positioning indicia on at least some of the panel faces to facilitate proper positioning of any particular panel face to display the indicia thereon. The details of the components may be as described above.

It is the primary object of the present invention to provide a simple, advantageous, and effective message display element and display jacket associated therewith. This and other objects of the invention will become clear from an inspection of the detailed description of the invention and from the appended claims.

DETAILED DESCRIPTION OF THE DRAWINGS

Figure 1:
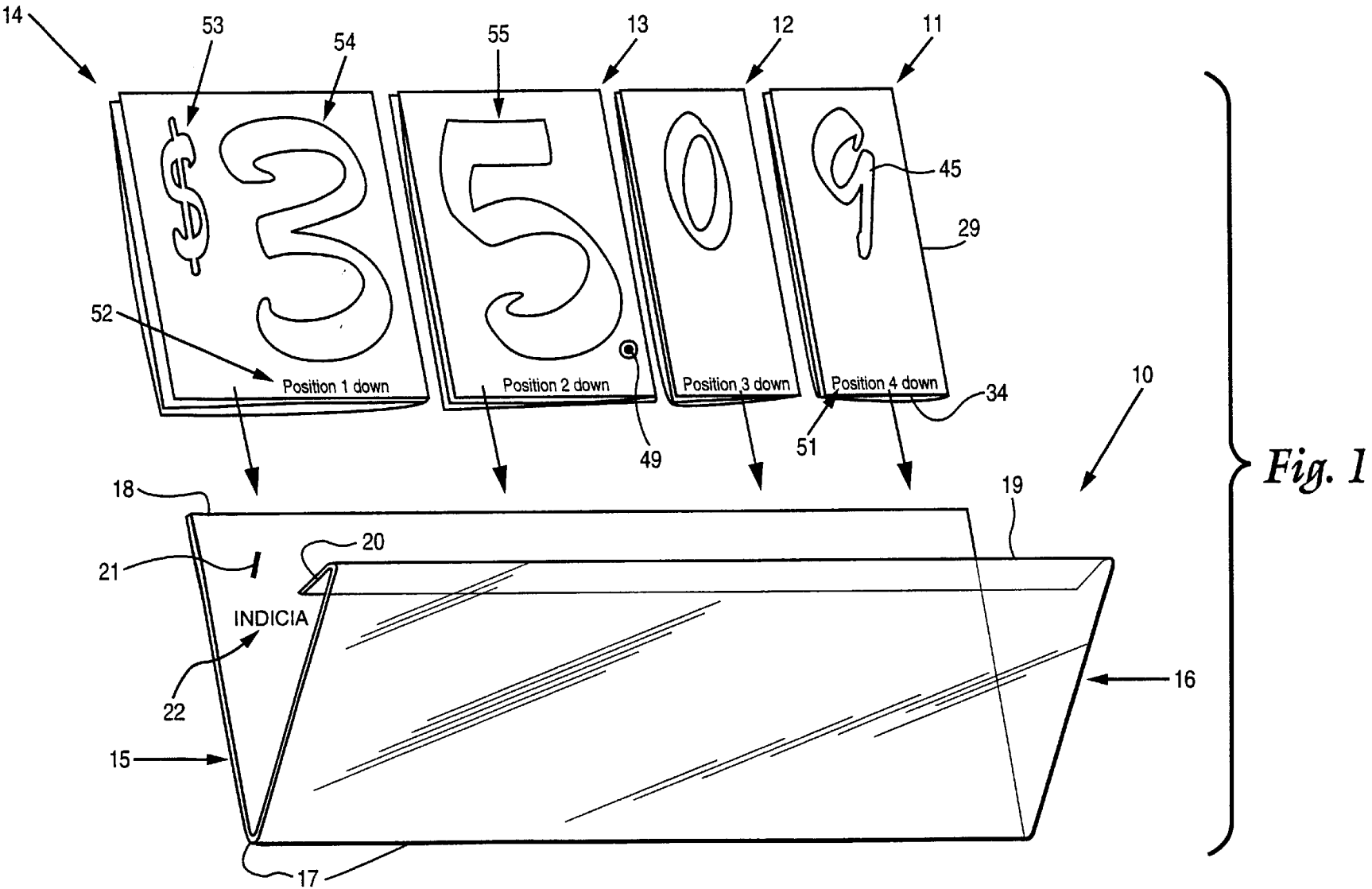
FIG. 1 is a front perspective exploded view of an exemplary message display jacket according to the invention with a plurality of message display elements according to the invention shown associated therewith.
Figure 2:
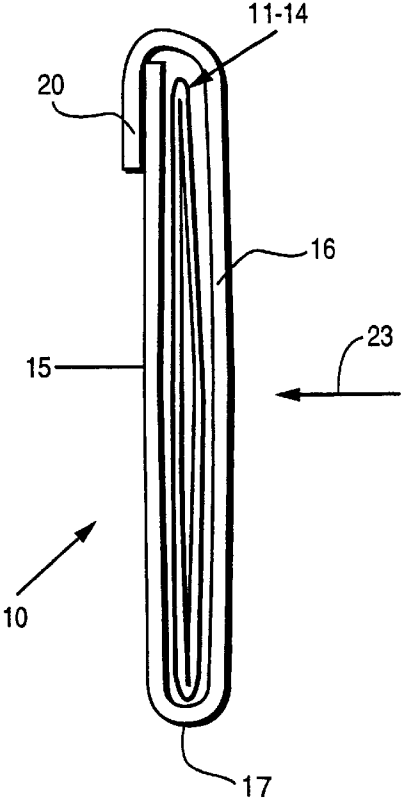
FIG. 2 is a side view of the assembled jacket and display element combination of FIG. 1.

An exemplary display jacket according to the present invention is shown generally by reference numeral 10 in FIGS. 1 and 2, and has a plurality of message display elements 11–14 associated therewith, each of the display elements 11–14 preferably comprising an integral sheet of material having a plurality of panels with different indicia on the majority of the panels, so as to be able to provide a readily adjusted message display. Preferably, the elements 11–14 have pricing indicia, such as numbers, dollar signs, decimal points, and the like associated therewith.

The jacket 10 has an inexpensive and simple construction, preferably comprising a single piece of relatively stiff plastic defining a first substantially planar element 15, a second substantially transparent substantially planar element 16, with an integral pivot 17 at the common bottom edge of the elements 15, 16. The element 15 has a top edge 18 and the element 16 a top edge 19, and a readily releasable latch mechanism is provided for holding the elements 15, 16 in proper juxtaposition with respect to each other when the message display elements 11–14 are positioned between them. Preferably the latch mechanism is the integral turned over lip 20 of the second element 16 which defines the top edge 19 thereof. While not necessary, preferably the face 21 of the first element 15, which faces the second element 16, is opaque (such as by printing it so that it is opaque or applying opaque covering thereto). Also, preferably the face 21 has indicia 22 imaged thereon. The indicia 22 preferably is graphic or pictorial indicia illustrating to a user how to effectively fold the display elements 11–14 (e.g. being substantially the same as what is illustrated in FIGS. 5A–5E.

FIG. 2 illustrates jacket 10 with the display elements 11–14 therein in the assembled condition so that the indicia on the elements 11–14 are clearly visible by looking at the transparent element 16 in the direction of arrow 23 in FIG. 2.

Figure 3:
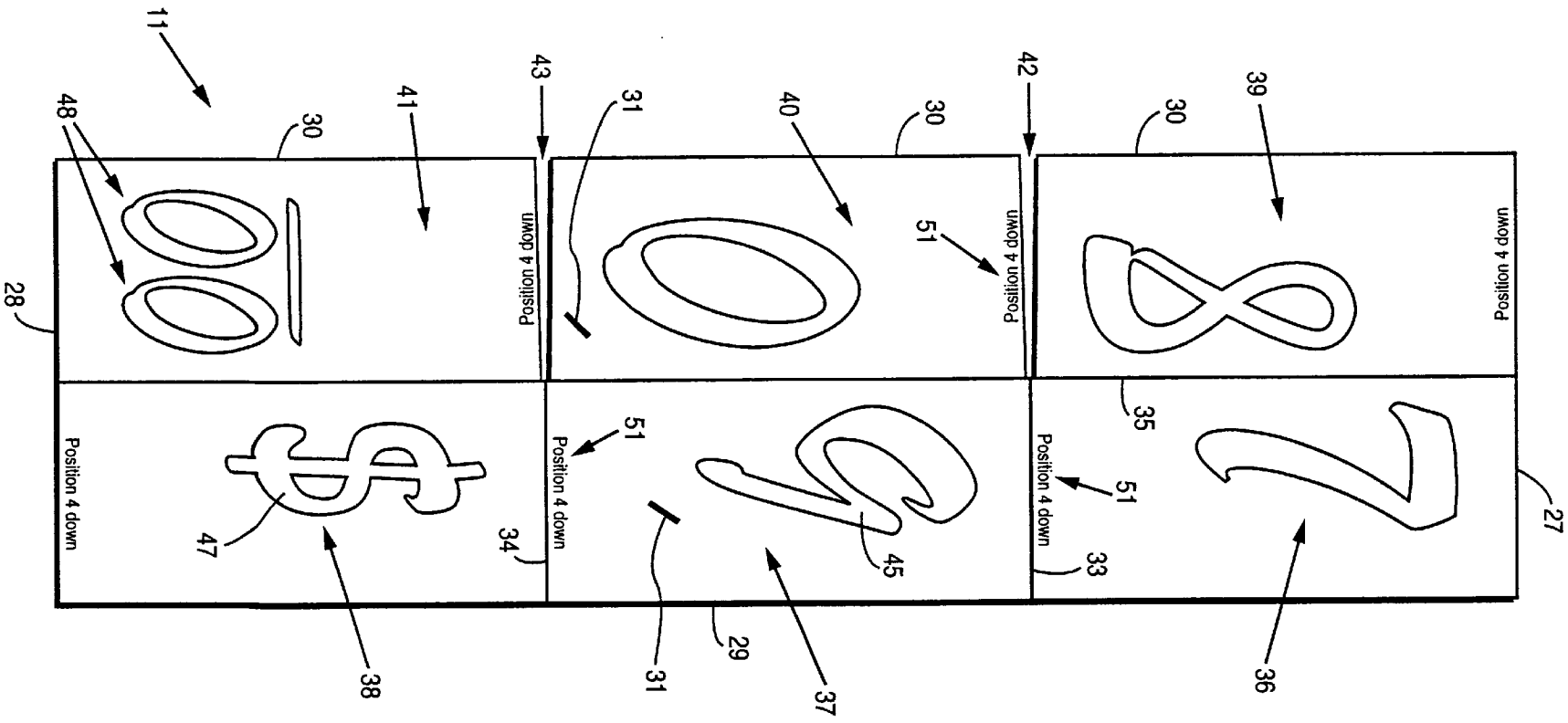
FIG. 3 is a top plan view of one embodiment of a message display element according to the present invention.
Figure 4:
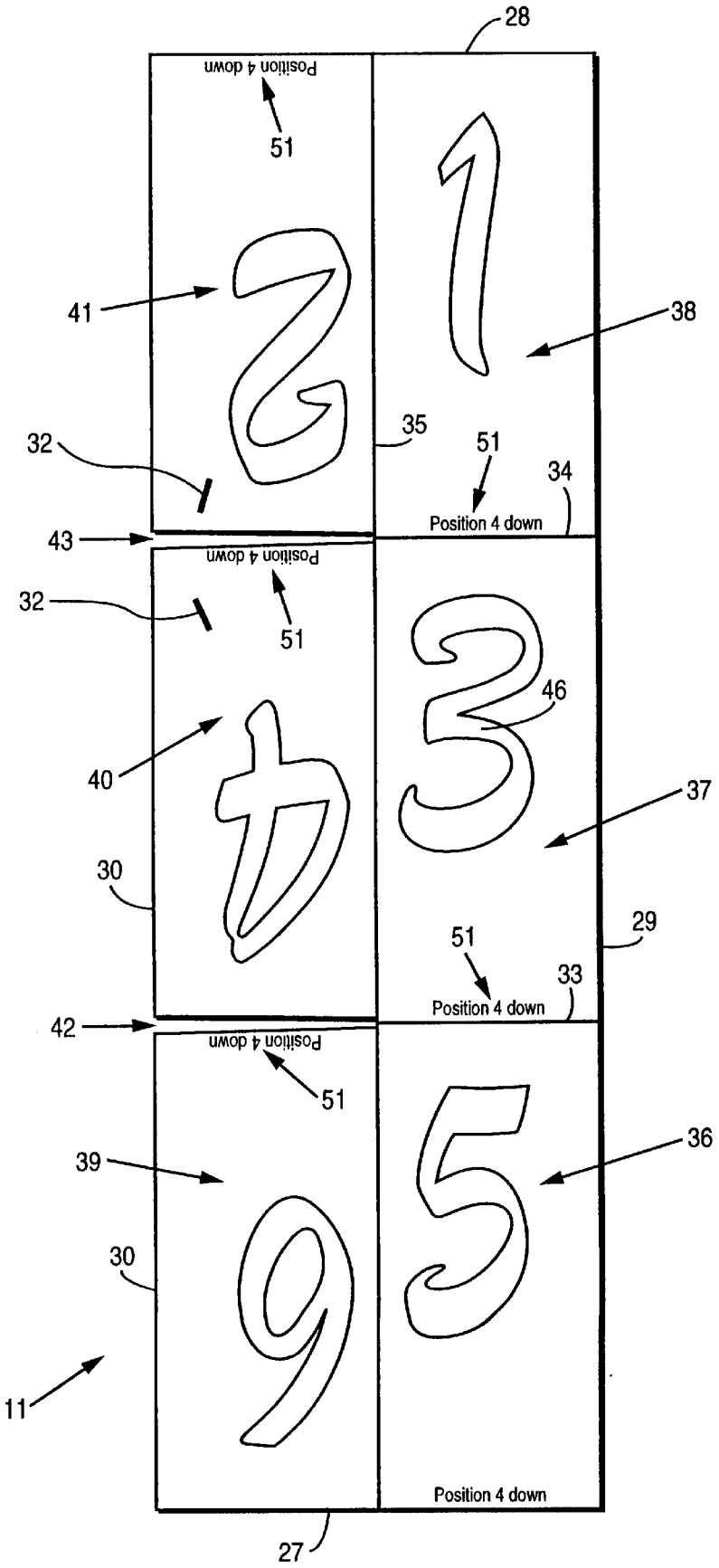
FIG. 4 is a view of the element of FIG. 3 only shown rotated 180° about a substantially horizontal axis (as viewed in FIG. 3) to show the bottom face thereof.

One of the exemplary display elements, the element 11 for simplicity of illustration, and its manner of use, are illustrated more clearly in FIGS. 3, 4, and 5A–5E. The display element 11 preferably comprises a substantially integral piece of sheet material, such as paper, cardboard, plastic, plastic impregnated paper, or the like. In the preferred embodiment the sheet material is plastic having a thickness of between about 8–20 mils (or any other narrower range within that broad range, e.g. 10–18 mils). The preferred plastic when the element 11 is to be used primarily for indoor use is PVC, and the preferred plastic when the element 11 is to be used primarily for outdoor use is polyolefin. The sheet is substantially quadrate and has top and bottom edges 27, 28 which are substantially parallel to each other, first and second side edges 29, 30 which are substantially parallel to each other and substantially perpendicular to the edges 27, 28, and top and bottom faces, the top face being indicated generally by reference numeral 31 as seen in FIG. 3, while the opposite, bottom face, is indicated generally by reference numeral 32 and is seen in FIG. 4.

The sheet forming the element 11 has at least first and second fold lines 33, 34 which are substantially parallel to the top and bottom edges 27, 28, and a third fold line 35 which is substantially parallel to the side edges 29, 30. The fold lines 33, 34, 35 define the element 11 into a plurality of panels which are not necessarily—though preferably—of substantially equal size. The first panel 36 is between the first side edge 29 and the third fold line 35, and the top edge 27 and the first fold line 33; the second panel 37 is between the edge 29 and fold lines 33–35; and the third panel 38 is between the edges 29, 28 and the fold lines 34, 35. The panels 36–38 are substantially in line as clearly seen in FIGS. 3 and 4.

The element 11 also includes at least fourth and fifth panels, and preferably at least fourth, fifth, and sixth panels 39–41, respectively. Any one of the panels 39, 40, 41 may optionally be omitted (and the remaining panels designated the fourth and fifth panels). In the embodiment illustrated in FIGS. 3 and 4, the fourth panel is defined by the edges 27, 30 and the fold line 35, the fifth panel 40 is defined by the edge 30 and the fold line 35, and the sixth panel 41 is defined by the edges 28, 30 and the third fold line 35. The panels 39–41 are substantially in line with each other, and connected to the panels 36–38 substantially only along the third fold line 35.

As clearly seen in each of FIGS. 3 through 5, the panels 39–41 preferably are not connected to each other, as indicated by the slits or gaps 42, 43 seen in FIGS. 3 and 4. The slits or gaps 43, 42 are preferably merely extensions of the fold lines 33, 34, and formed simply by severing the element 11 with scissors, a cutter, or other sharp edge, laser beam etc. The provision of the slits 42, 43 so that the panels 39–41 are unconnected to each other, facilitates the element 11 laying flat when folded and in use, and facilitates folding action.

At least some of the panels 36–41, typically most of the panels 36–41, and preferably all of the panels 36–41, have message display indicia on both faces 31, 32 thereof. In the preferred embodiment illustrated in FIGS. 3 and 4, the message display indicia comprises pricing information, preferably the numerals 0 through 9, one of the numerals 0 through 9 provided on each of the different panel faces. That is, the display message indicia comprising the numeral 9, indicated at 45 in FIG. 3, is on the first face 31 of the second panel 37, while the numeral 3, indicated at 46 in FIG. 4, is on the second face 32 of the second panel 37. Preferably the numerals 0 through 9 have the relationship indicated in FIGS. 3 and 4 with respect to each other and the faces 31, 32, although other configurations may be provided. That is, the numbers 1 and 2 are on adjacent panels 38, 41 and have an opposite orientation (one being upside down with respect to the other), the numerals 3 and 4 are on the panels 37, 40 faces 32 adjacent the panels 38, 41 with the number 3 having the same orientation as the number 1, and the number 4 having the same orientation as the number 2; the numerals 5 and 6 are on the panels 36, 39 second face 32 adjacent the panels 37, 40, with the numeral 5 having the same orientation as the numeral 3, and the numeral 6 the same orientation as the numeral 4; and similarly for the numerals 7–0, as illustrated in FIG. 3. Also, other indicia can be provided (preferably associated with pricing) such as a dollar sign as indicated at 47 in FIG. 3, a double zero ("00") as indicated at 48 in FIG. 3, a decimal point (such as indicated at 49 in FIG. 1, either with a numeral or by itself), an indication of price product weight or volume (such as "lb." or "#" or "/qt."), etc. Non-pricing information may also be displayed such as words, letters, or symbols (such as a picture of a product).

At least some of the panels 36–41 on at least one of the faces 31, 32 thereof preferably also have orientation and position indicia, such as illustrated at 51 on each of the panels 36–41, each of the faces 31, 32, in FIGS. 3 and 4. The indicia 51 is to assist the user of the element 11 in properly positioning the elements within the jacket 10, and so that the indicia thereon (such as the numerals 45, 46) has the proper orientation. While exactly what the indicia 51 says can vary widely, for the embodiment illustrated in FIGS. 3 and 4, the indicia 51 is "position 4 down". That means that the element 11 is the fourth element from the left when inserted into the jacket 10 (as seen in FIG. 1), and that the indicia 51 is at the bottom of the panel 36–41 (and thus is adjacent the bottom pivoted edge 17 of the elements 15, 16 as seen in FIGS. 1 and 2). The indicia 51 need not be provided on every panel face, although that is preferred as illustrated in FIGS. 3 and 4. The other elements 12–14 will have similar indicia, for example, the indicia 52 (see FIG. 1) on element 14 which says "position 1 down", and similarly for the elements 12 and 13. As also illustrated in FIG. 1, more than one individual character may be provided as the indicia on any panel face of any of the elements 11 through 14, such as both the dollar sign 53 and a numeral 54 being provided on the first position element 14, the decimal point 49 and the numeral 55 on the second position element 13, etc.

Figure 5A:
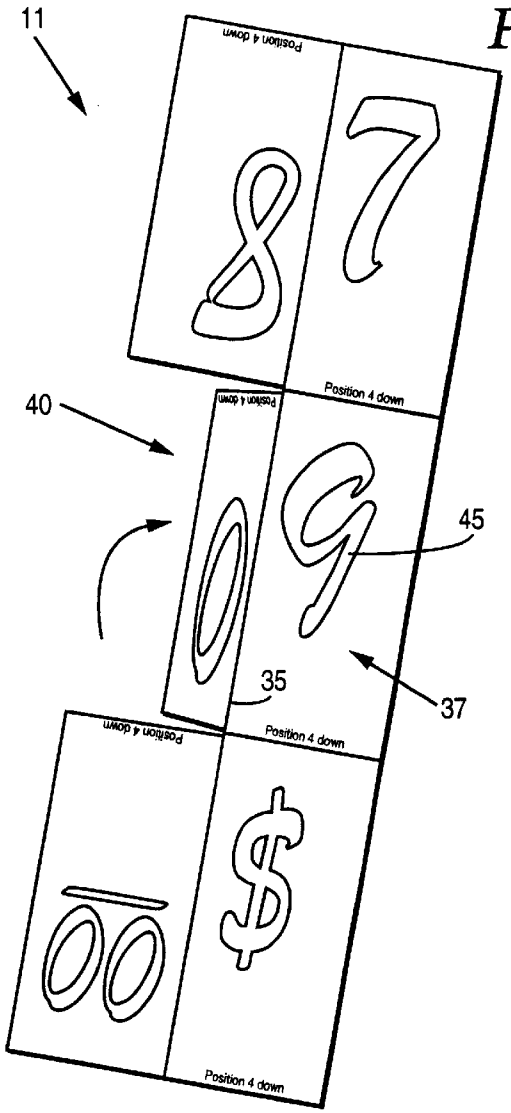
FIGS. 5A through 5E are schematic illustrations showing the folding of the display element of FIGS. 3 and 4 to define a single visible panel for use as illustrated in FIGS. 1 and 2.
Figure 5B:
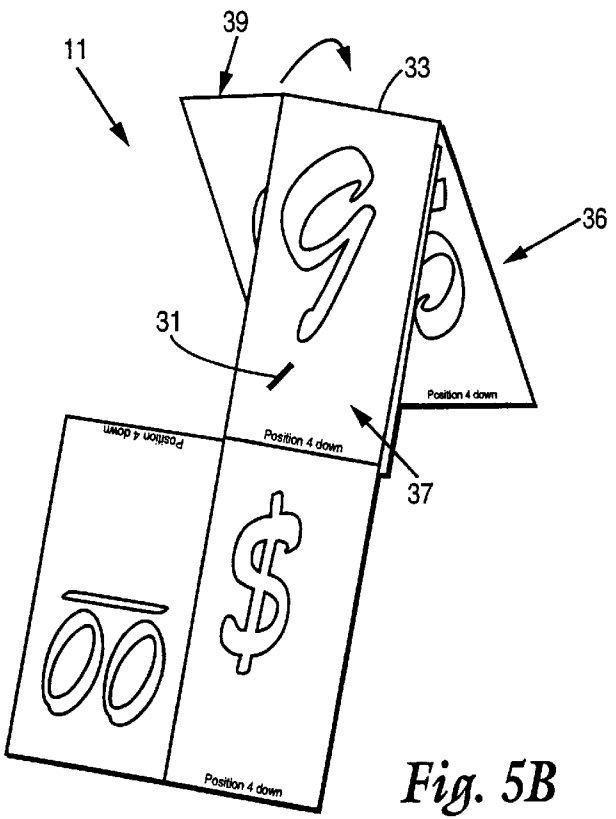
Figure 5C:
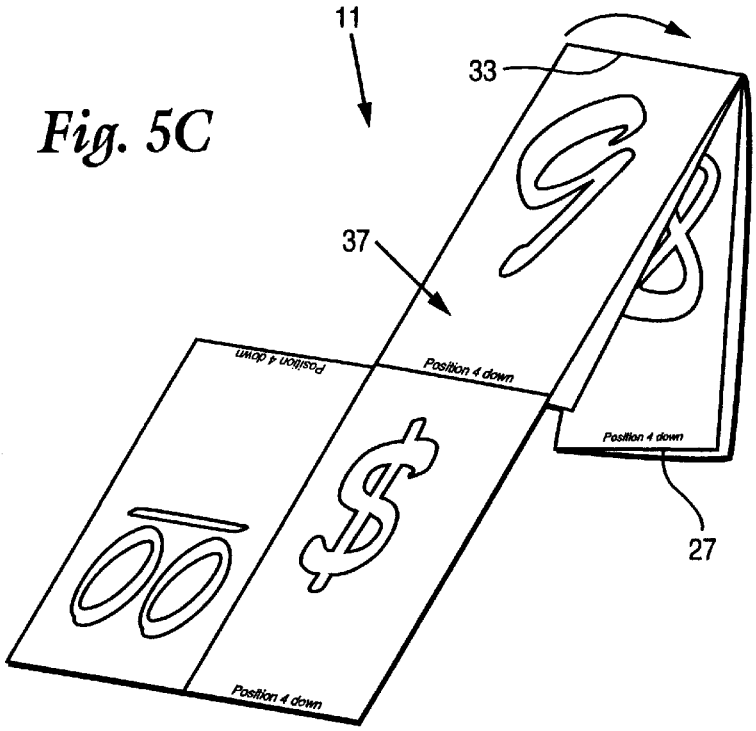
Figure 5E:
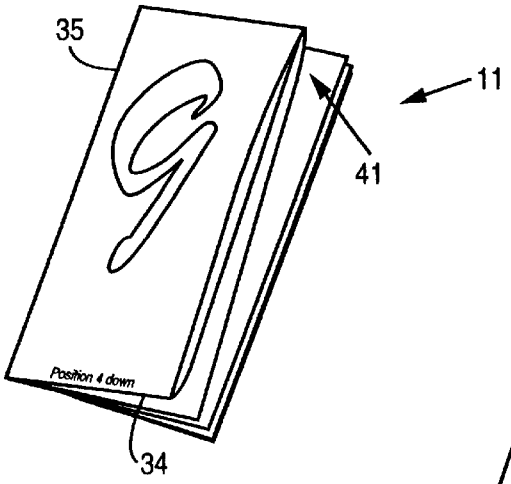
Figure 5D:
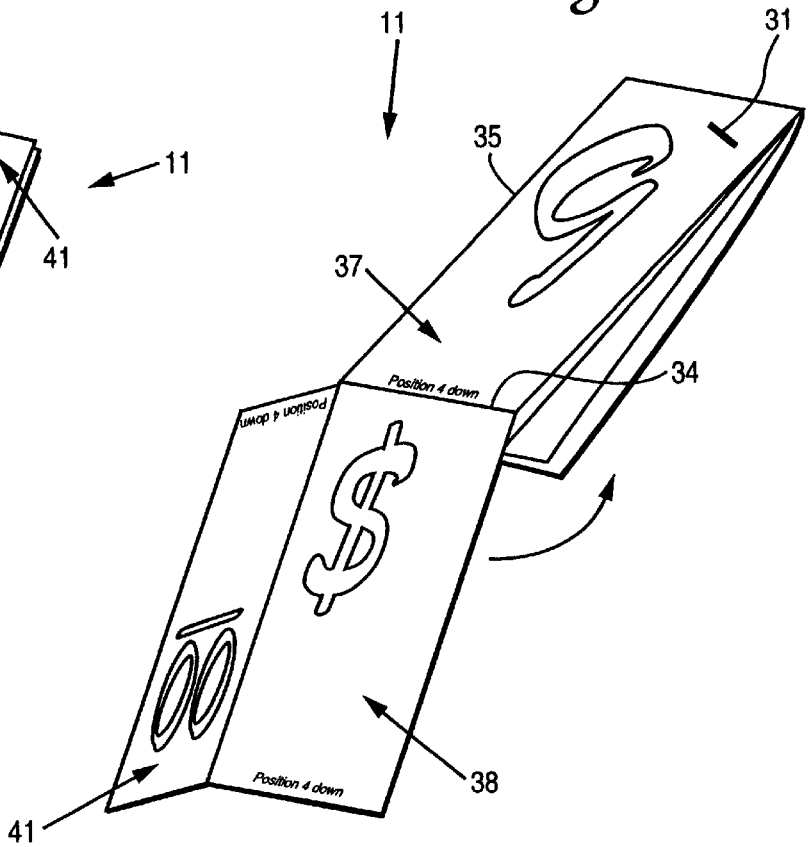

FIGS. 5A–5E show a simple method for folding the various panels of the element 11 with respect to each other so as to lie as flat as possible, and so that the folding is as simple and convenient as possible. While the exact order of the steps may change, in the preferred embodiment illustrated in FIGS. 5A–5E where it is desired to have the numeral 9, indicated at 45, as the indicia of the element 11 to be displayed in the jacket 10, the panel 40 is folded about the fold line 35 so that it is behind the panel 37 (with the indicia 45 at the front), as illustrated in FIG. 5A. Then the panels 36, 39 are folded about the first fold line 33 so that they are in back of the face 31 of panel 37 as illustrated in FIG. 5B, and then the panels 36, 39 are folded with respect to each other about the fold line 35 therebetween as illustrated in FIG. 5C. Then, as illustrated in FIG. 5D, the panels 38, 41 are folded about the fold line 34 so that they are in back of the face 31 of the panel 37, and indeed in back of all of the panels 36, 37, 39, and 40, and as illustrated in FIG. 5E the panel 41 is pivoted about the third fold line 35 with respect to the panel 38 so that it is the last panel in the folded configuration of the element 11, as seen in FIG. 5E.

The final folded element—as illustrated in FIG. 1—then has the following order of panels from the numeral 45 rearward; 37, 40, 36, 39, 38, and 41. The display element 11 is thus easy to fold even when of relatively stiff material such as about 12 mil PVC or polyolefin, and lays flatter than if all of the panels 36–41 were in a continuous in-line strip, and the desired indicia may be easier to find and feature. Also, all of the components 10–14 may be made inexpensively, and even though the components 11–14 have different sizes they may be readily properly positioned in the jacket 10 simply by viewing the orientation and position indicia, such as the indicia 51, 52 thereon. Thus, according to the invention pricing or like message display indicia may be simply, quickly, and efficiently changed.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A message display element comprising:

a substantially integral piece of sheet material having top and bottom substantially parallel edges, first and second substantially parallel side edges, and top and bottom faces, said side edges substantially perpendicular to said top and bottom edges;

at least first and second fold lines substantially parallel to said top and bottom edges, and at least a third fold line substantially parallel to said first and second side edges, said fold lines defining said sheet material into at least first, second, and third substantially in-line panels between said first side edge and said third fold line, and at least fourth and fifth substantially in-line panels between said second side edge and said third fold line, said panels having top and bottom faces;

message indicia provided on both said top and bottom faces of at least a plurality of said panels; and said fourth and fifth panels being unconnected to each other and connected to said first, second, or third panels substantially only at said third fold line.

2. A message display element as recited in claim 1 further comprising at least a sixth panel substantially in line with said fourth and fifth panels and disposed between said second side edge and said third fold line, said sixth panel having top and bottom faces unconnected to said fourth and fifth panels and connected to said first, second, or third panel substantially only along said third fold line.

3. A message display element as recited in claim 2 wherein said display element consists essentially of said first, second, third, fourth, fifth and sixth panels.

4. A message display element as recited in claim 3 wherein said message indicia is provided on both said top and said bottom faces of at least four of said panels.

5. A message display element as recited in claim 4 wherein said message display indicia comprises pricing indicia.

6. A message display element as recited in claim 4 wherein said message display indicia comprises numerals 0 through 9, each panel face having only one of said numerals 0 through 9 thereon.

7. A message display element as recited in claim 1 wherein said message display indicia is provided on said top and bottom faces of all of said panels.

8. A message display element as recited in claim 1 wherein said message display indicia comprises numerals 0 through 9, each panel face having only one of said numerals 0 through 9 thereon.

9. A message display element as recited in claim 1 wherein said sheet material comprises plastic sheet material having a thickness between 8–20 mils.

10. A message display element as recited in claim 9 wherein said plastic comprises polyvinyl chloride.

11. A message display element as recited in claim 9 wherein said plastic comprises polyolefin.

12. A message display element as recited in claim 1 further comprising orientation and positioning indicia on at least some of said panel faces to facilitate proper positioning of any particular panel face to display said indicia thereon.

13. A message display element as recited in claim 1 in combination with a display jacket comprising a first substantially planar element having dimensions larger than a dimension of any one panel of said sheet material, and having substantially parallel top and bottom edges;

a second substantially transparent, substantially planar element having top and bottom edges;

said first and second substantially planar elements pivotally connected together at or adjacent said bottom edges thereof;

said sheet material when folded about said fold lines to define an element having length and width dimensions corresponding to a single one of said panels insertable between said first and second substantially planar elements; and a latch mechanism which holds the first and second substantially planar elements in a predetermined relationship with respect to each other to retain said folded display element therebetween, so that said message display indicia on one of said panels is readily viewed through said substantially transparent second substantially planar element.

14. A combination as recited in claim 13 wherein said latch element comprises a turned over portion of said second substantially planar element defining the top edge thereof.

15. A combination as recited in claim 13 further comprising orientation and positioning indicia on at least some of said panel faces to facilitate proper positioning of any particular panel face to display said message indicia thereon.

16. A display jacket for display element panels comprising:

a first substantially planar element having dimensions larger than a dimension of any one of said display element panels, and having substantially parallel top and bottom edges;

a second substantially transparent, substantially planar element having top and bottom edges;

said first and second substantially planar elements pivotally connected together at said bottom edges thereof;

a plurality of said display element panels having message indicia thereon disposed between said first and second substantially planar elements so that said message indicia is visible through said substantially transparent second element;

a readily releasable latch mechanism which holds the first and second substantially planar elements in a predetermined relationship with respect to each other to retain said display element panels therebetween, so that said message display indicia on one of said panels is readily viewed through said substantially transparent second substantially planar element;

said first and second substantially planar elements, said pivot, and said latch mechanism comprising an integral piece of plastic; and instructional indicia graphically indicating folding of said panels to be effectively disposed between said first and second substantially planar elements, said instructional indicia being provided on said first substantially planar element and visible through said second substantially transparent substantially planar element; and wherein said latch mechanism comprises a turned over portion of said second substantially planar element defining the top edge thereof.

17. A display jacket as recited in claim 16 further comprising orientation and positioning indicia on said display element panels advising of a proper position and orientation of said panel between said first and second substantially planar elements.

18. A message display element comprising:

a substantially integral piece of sheet material having top and bottom substantially parallel edges, first and second substantially parallel side edges, and top and bottom faces, said side edges substantially perpendicular to said top and bottom edges;

at least first and second fold lines substantially parallel to said top and bottom edges, and at least a third fold line substantially parallel to said first and second side edges, said fold lines defining said sheet material into at least first, second, and third substantially in-line panels between said first side edge and said third fold line, and at least fourth and fifth substantially in-line panels between said second side edge and said third fold line;

message indicia provided on both said top and bottom faces of at least a plurality of said panels; and orientation and positioning indicia on at least some of said panel faces to facilitate proper positioning of any particular panel face to display said message indicia thereon.

19. A message display element as recited in claim 18 wherein said sheet material comprises plastic sheet material having a thickness between 8–20 mils.

* * * * *